US008907861B2

(12) United States Patent
Hirt

(10) Patent No.: US 8,907,861 B2
(45) Date of Patent: Dec. 9, 2014

(54) ANTENNAS INTEGRATED WITH DIELECTRIC CONSTRUCTION MATERIALS

(75) Inventor: Fred S. Hirt, Brookfield, IL (US)

(73) Assignee: Proxense, LLC, Bend, OR (US)

( * ) Notice: Subject to any disclaimer, the term of this patent is extended or adjusted under 35 U.S.C. 154(b) by 380 days.

(21) Appl. No.: 12/262,066

(22) Filed: Oct. 30, 2008

(65) Prior Publication Data

US 2009/0195461 A1 Aug. 6, 2009

Related U.S. Application Data

(60) Provisional application No. 60/985,038, filed on Nov. 2, 2007.

(51) Int. Cl.

| | |
|---|---|
| ***H01Q 1/42*** | (2006.01) |
| ***H01Q 1/40*** | (2006.01) |
| ***H01Q 1/44*** | (2006.01) |
| ***H01Q 19/10*** | (2006.01) |
| ***H01Q 21/06*** | (2006.01) |

(52) U.S. Cl.

CPC . *H01Q 1/44* (2013.01); *H01Q 1/40* (2013.01); *H01Q 1/42* (2013.01); *H01Q 19/10* (2013.01); *H01Q 21/06* (2013.01)

USPC ..... 343/873; 343/702; 343/795; 343/911 R

(58) Field of Classification Search

CPC ..... H01Q 1/40; H01Q 19/10; H01Q 1/42; H01Q 1/44; H01Q 21/06

USPC ..... 343/702, 873, 878–879

See application file for complete search history.

(56) References Cited

U.S. PATENT DOCUMENTS

| | | | | |
|---|---|---|---|---|
| 5,729,237 | A * | 3/1998 | Webb | 343/700 MS |
| 5,760,744 | A * | 6/1998 | Sauer | 343/700 MS |
| 6,219,553 | B1 * | 4/2001 | Panasik | 455/446 |
| 6,563,465 | B2 * | 5/2003 | Frecska | 343/700 MS |
| 6,593,887 | B2 * | 7/2003 | Luk et al. | 343/700 MS |
| 6,714,168 | B2 * | 3/2004 | Berenbaum | 343/873 |
| 6,715,246 | B1 * | 4/2004 | Frecska et al. | 52/220.6 |
| 6,947,003 | B2 * | 9/2005 | Huor | 343/770 |
| 6,999,032 | B2 * | 2/2006 | Pakray et al. | 343/713 |
| 7,330,108 | B2 * | 2/2008 | Thomas | 340/505 |
| 7,461,444 | B2 * | 12/2008 | Deaett et al. | 29/600 |
| 7,583,238 | B2 * | 9/2009 | Cassen et al. | 343/872 |
| 7,595,765 | B1 * | 9/2009 | Hirsch et al. | 343/789 |
| 8,395,484 | B2 * | 3/2013 | Fullerton | 340/10.4 |
| 2006/0097949 | A1 * | 5/2006 | Luebke et al. | 343/873 |
| 2006/0187029 | A1 * | 8/2006 | Thomas | 340/539.13 |
| 2008/0218416 | A1 * | 9/2008 | Handy et al. | 343/700 MS |

OTHER PUBLICATIONS

Cisco Systems, Inc., Antenna Patterns and Their Meaning, Copyright 1992-2007, p. 10.*

Balanis, Constantine, A., Antenna Theory: A Review, Jan. 1992, Proceedings of the IEEE, vol. 80, No. 1, p. 13.*

(Continued)

*Primary Examiner* — Robert Karacsony
*Assistant Examiner* — Amal Patel
(74) *Attorney, Agent, or Firm* — Patent Law Works LLP

(57) ABSTRACT

Antenna radiating elements are combined with dielectric construction materials, with the radiating elements designed to produce a certain radiation pattern taking into account the construction materials.

25 Claims, 5 Drawing Sheets

(56) References Cited

OTHER PUBLICATIONS

National Criminal Justice Reference Service, Antenna Types, Dec. 11, 2006, found at http://www.ncjrs.gov/pdffiles1/nij/185030b.pdf, p. 17-18.*

Lee, R.Q.; Zaman, A.J.; Lee, K.F.; , "Effects of dielectric superstrates on a two-layer electromagnetically coupled patch antenna," Antennas and Propagation Society International Symposium, 1989. AP-S. Digest , vol., No., pp. 620-623 vol. 2, Jun. 26-30, 1989, found at: http://ieeexplore.ieee.org/stamp/stamp.jsp?tp=&arnumber=1347.*

* cited by examiner

ANTENNAS INTEGRATED WITH DIELECTRIC CONSTRUCTION MATERIALS

CROSS-REFERENCE TO RELATED APPLICATIONS

The present application claims the benefit of priority under 35 U.S.C. §119(e) of U.S. Provisional Application No. 60/985,038 entitled "Integrated Dielectric-Lensed Location-Tracking Antennas Fabricated Within Common Construction Materials" filed on Nov. 2, 2007, the entire contents of which are incorporated by reference herein.

BACKGROUND

1. Field of Art

The invention generally relates to antennas, including for example the combination of RF radiating elements with dielectric construction materials.

2. Description of the Related Art

Traditionally, antennas were positioned, and aimed, to avoid obstructions in order to both minimize losses and preserve the antenna's theoretical, free-space radiation pattern. Increased use of Radio Frequencies (RF) and microwaves in consumer and industrial products have created challenges which require the use of antennas near, and in some cases behind or within, obstructing bodies. Examples include the radiating antennas in AMPS cell phones (800-900 MHz), PCS cell phones (1.8-1.9 GHz), cordless phones, and Wi-Fi devices (2.4-2.5 GHz, 5.7-5.8 GHz). The majority of these devices attempt to concentrate their radiated energy away from the user, with dielectric losses and the antenna's radiation pattern controlled by the manufacturer's selection of housing or radome material and the relative placement of the radiating elements within the housing or radome.

In contrast, antennas which are designed for use within a structure (e.g., for infrastructure deployment) typically must contend with reflections and attenuation due to the intervening walls, ceilings, and other internal structural elements and objects. Attempts to ameliorate the scattering effects of boundaries have generally concentrated on narrowing an antenna's radiation pattern, deploying multiple radiators to illuminate "shadowed" regions, deploying traveling wave or "leaky" antenna structures, utilizing Multiple-Input, Multiple Output (MIMO) antenna signal processing, or utilizing other antenna spatial-temporal techniques to modify the antenna radiation coverage of space. Although each is effective in some set of applications, none act to address the root cause of the problem, specifically, the reflection and attenuation of radiation by the non-transparency of the boundaries themselves.

Furthermore, in cases where the antenna is to be located in a structure (e.g., inside a building) in the most unobtrusive manner possible, it is usually desirable to disguise the antenna, for example to resemble a speaker grille, an HVAC vent, a smoke detector, or a ceiling tile. This visual obscuration is typically accomplished by either placing the antenna behind a structural element (e.g., behind a wall, beneath the floor, or above the ceiling) or by placing camouflaging material around the antenna. One problem with these approaches is that it typically places dielectric material in close proximity to the antenna, which then alters both the antenna's feed-point impedance and its radiation pattern.

FIGS. 1A and 1B illustrate this effect. FIG. 1A shows the free-space radiation pattern 110 of an antenna 120. The antenna 120 is designed specifically to have this radiation pattern 110 and typically will be assumed to have this radiation pattern 110 when installed in the field.

In FIG. 1B, the antenna 120 is installed on one side of a wall 150 (or other obstructing dielectric object). The target volume 160 is on the other side of the wall. For example, the target volume 160 may be the space where people or objects are located and the antenna 120 is installed on the opposite side in order to hide it from view. The wall 150 has two surfaces 155A and 155B. The wall 150 is constructed from a material that acts as a dielectric but has a different dielectric constant than free space. Therefore, the wall 150 distorts the free-space radiation pattern of the antenna 120. FIG. 2 shows both refraction and reflection at each surface 155 as the various rays propagate through the wall 150. This occurs because there is an air-wall interface at each surface 155 and the dielectric constant is different on the two sides of the interface. The superposition of these refractions and reflections produce the actual radiation pattern 127 for the antenna 120 distorted by wall 150.

The resulting antenna detuning, shift of center frequency, and broadening (i.e. loss of directivity) of the radiation pattern 127 is a function of the dielectric constant and thickness of the wall 150, and the relative positions of the intervening material 150, the radiator 120 and the intended target volume 160. While it may be possible to "tune" or otherwise adjust the free-space radiation pattern of the antenna 120 to compensate for this effect in any particular situation, each situation typically will be different. For example, the relative placement, thickness, constituency, dielectric constant or dielectric tensor (if the material is non-homogeneous, chiral, or otherwise polarizing) may differ from one case to the next. Thus, either each antenna will have to be tuned individually to match its situation, which would require a significant amount of work, or certain antennas will not be tuned to match their individual situations. Neither approach is particularly attractive.

SUMMARY

Various drawbacks of the prior art are overcome by making the boundary materials an integral part of the radiation process. For example, in one approach, an (RF) antenna apparatus produces a predetermined radiation pattern, already accounting for the boundary materials. The antenna apparatus includes a construction component suitable for use in building structures, an RF port and one or more radiating element(s) embedded within the construction component. Examples of construction components include components for use in walls, ceiling or floors. The construction component contains a dielectric construction material, for example gypsum board, particle board, plywood, fiberglass, cement board, chipboard wall, floor underlayment materials, Styrofoam, rigid board, insulating foam and ceiling tile materials. The radiating element(s) are embedded within the construction component and radiate directly into the dielectric construction material to produce the predetermined radiation pattern outside the construction component. Since the radiating element(s) are embedded, the relative positions and characteristics of the dielectric construction material are known and can be accounted for in the design of the radiating element(s). Radiating directly into the dielectric construction material reduces the number of air interfaces. The RF port is attached to the construction component and provides an electrical connection from the outside world to the radiating element(s).

Various implementations may have any of the following features. Examples of radiating element(s) include conducting linear rod(s), conducting flat surface(s) and arrays of conducting elements. Arrays can be planar or non-planar (i.e., three-dimensionally positioned within the construction component), period or non-periodic. The dielectric construction material may be positioned and shaped to produce a "lensing" effect, thus enhancing the directivity of the radiation pattern. The radiation pattern can be one-sided (i.e., directed primarily to one side of the construction component), two-sided (i.e., directed equally to opposite sides of the construction component), or non-directional. If directional, the radiation pattern can have a maximum gain along a direction that is substantially perpendicular to a surface of the construction component (e.g., perpendicular to the surface of a wall). It can also be designed so that the maximum gain is along a direction that is not substantially perpendicular.

In one particular class of designs, the RF antenna apparatus also includes a conducting sub-reflector embedded within the construction component. The sub-reflector is positioned relative to the radiating element(s) and the dielectric construction material to enhance a directivity of the radiation pattern. For example, the RF antenna apparatus may be designed to produce a radiation pattern primarily to one side of a wall (referred to as the preferred side of the wall). The radiating element(s) may be an array of conducting elements embedded in the wall, with the sub-reflector positioned within the wall but on the opposite side of the radiating element(s) (i.e., towards the non-preferred side of the wall). Thus, the sub-reflector reduces the radiation pattern on the non-preferred side of the wall.

In another aspect, an RF antenna assembly is designed to be attached to a surface of an object to produce a predetermined radiation pattern. The object contains a dielectric construction material, and the antenna assembly is designed accounting for the dielectric construction material. The assembly itself contains one or more radiating element(s) and an RF port. When attached to the surface of the object, the radiating element(s) radiate directly into the dielectric construction material contained in the object, thus producing the predetermined radiation pattern outside the object.

Many of the features described above can also be applied to the RF antenna assembly. For example, the antenna assembly can be designed to have a one-sided radiation pattern, the dielectric construction material can be used to enhance the directivity of the radiation pattern and/or the antenna assembly can also include a conducting sub-reflector. In one design, the antenna assembly is a conformal structure attachable to the surface of the object by an adhesive compound.

The RF antenna assembly can be designed for attachment to many different types of objects. The construction components described above are one class of objects, for example in order to retrofit existing walls, ceilings and floors. Fixtures are another class of objects. In hotels, they may be attached to furniture, pedestals, or other heavy or semi-permanent objects. In casinos, they may be attached to gaming tables (or supports for gaming tables) or different parts of gaming machines (e.g., the base of a slot machine).

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

Figure 2:
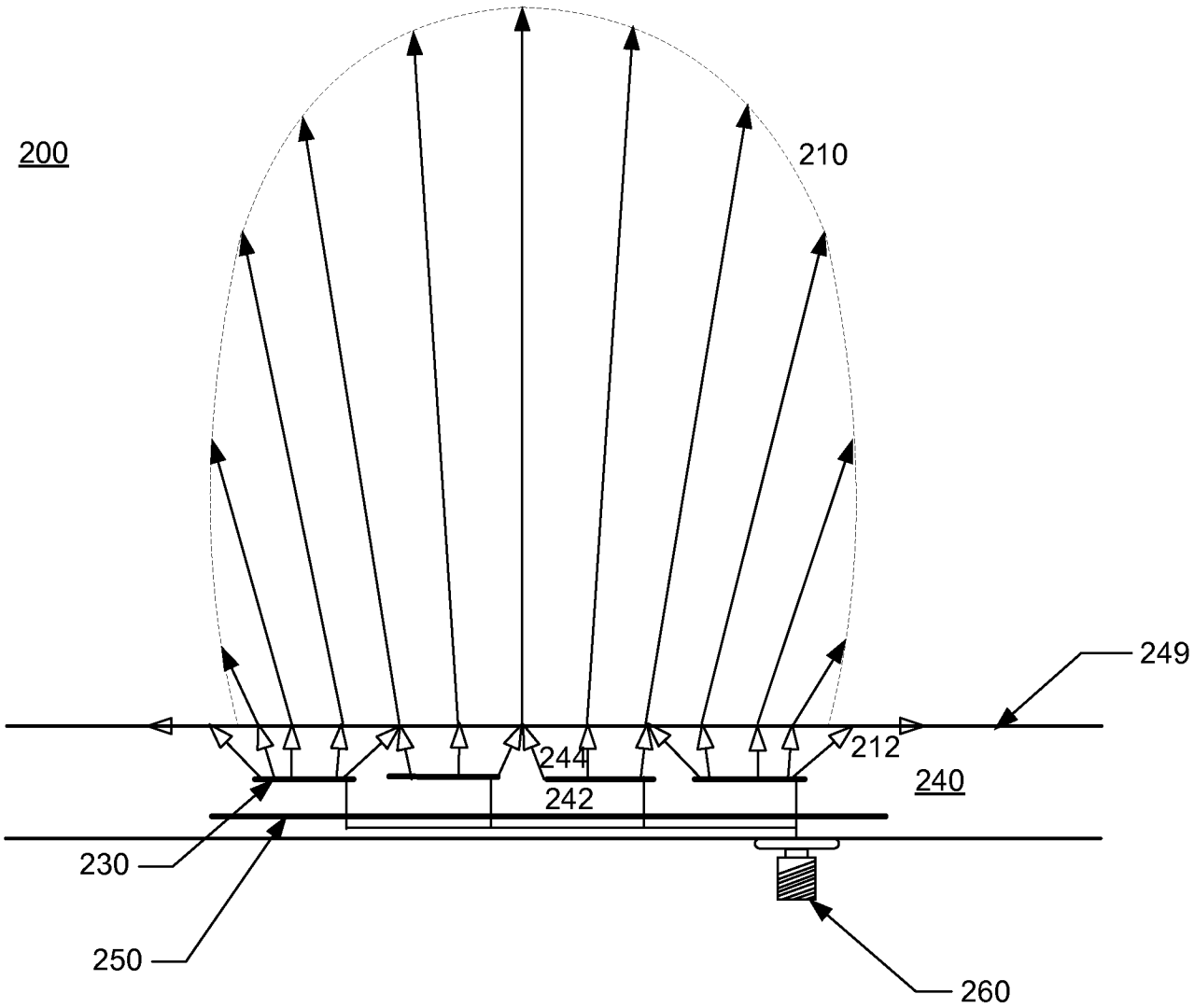
FIG. 2 is a cross-section view of an example unidirectional antenna apparatus.

FIG. 2 shows a cross-section of an example unidirectional antenna apparatus 200 according to the invention. In this example, the radiating structure resides wholly within the dielectric construction material 240 of a construction component 249. The radiating structure in this example includes four radiating patch elements 230 (which could be linear, circular, serpentine or other), dielectric backing 242 and sub-reflector 250. The dielectric backing 242, which is a portion of the dielectric construction material 240, is designed to provide both a substance to mechanically support the radiating elements 230 and to provide an increase in the dielectric constant of the material 242 behind the radiating elements 230 relative to air. This latter effect acts to reduce the spacing required between the radiating elements 230 and the sub-reflector 250, such reduction in overall volume being a desirable quality. An RF port 260 is also attached to the construction component 249 and provides an external electrical connection to the embedded radiating elements 230. Note that the RF port 260 and radiating elements 230 are not electrically connected to the sub-reflector 250, although FIG. 2 shows electrical traces crossing the sub-reflector 250.

Figure 1A:
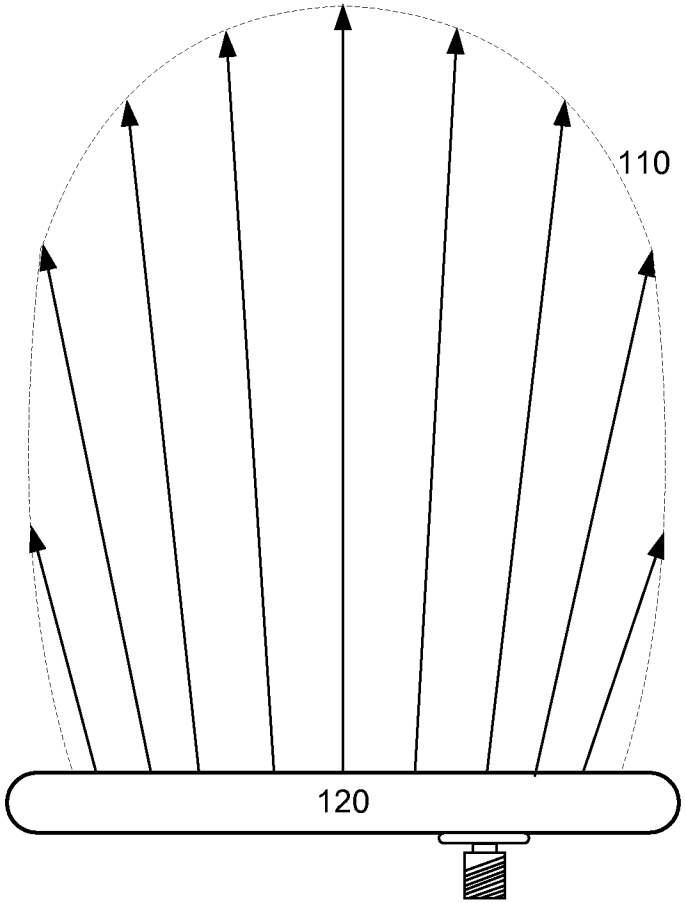
FIG. 1A (prior art)
FIG. 1A (prior art) is a diagram of a free-space radiation pattern for an antenna.
Figure 1B:
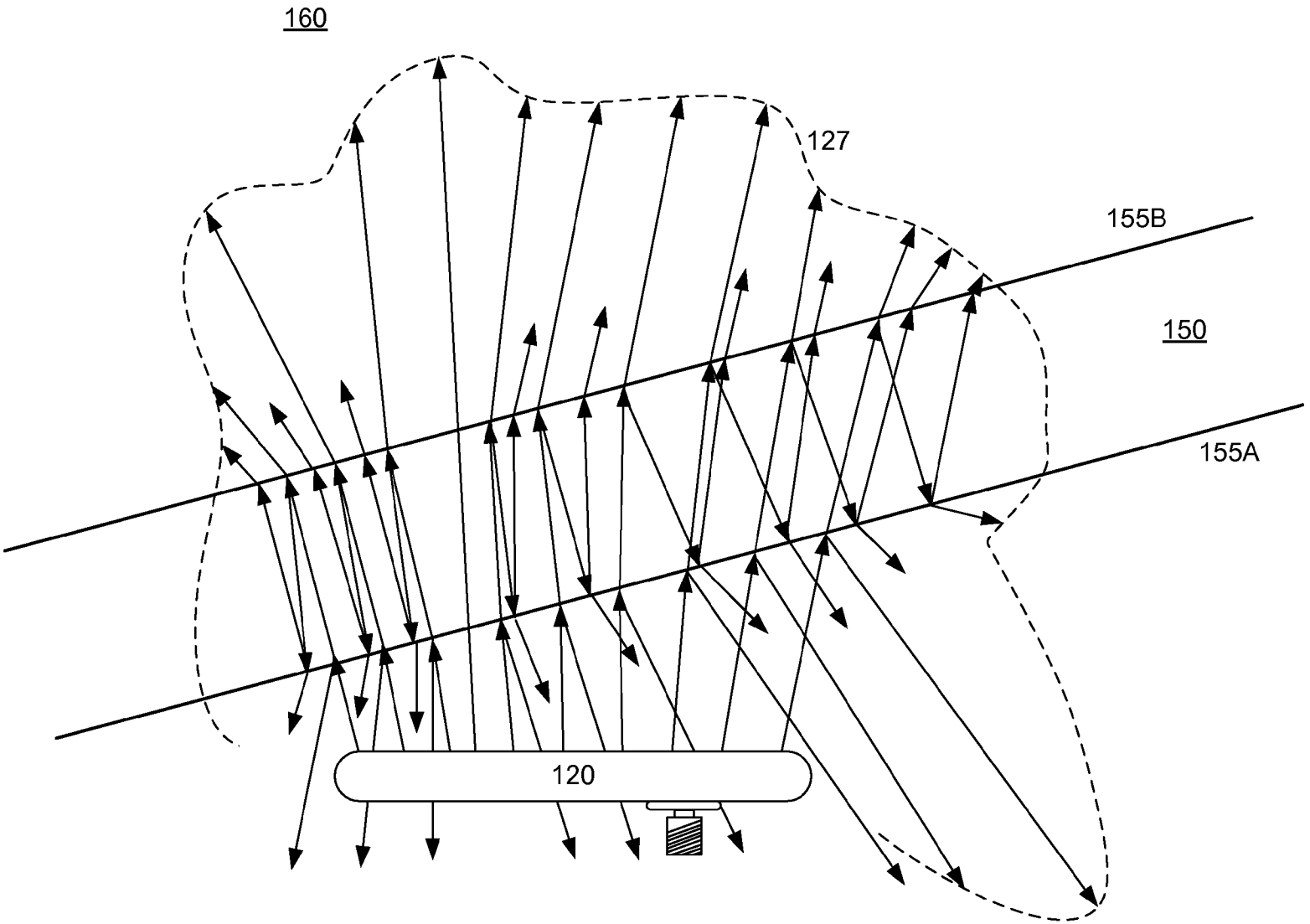
FIG. 1B (prior art)
FIG. 1B (prior art) is a diagram illustrating distortion of the radiation pattern for an antenna.

Note that the antenna apparatus shown in FIG. 2 is not simply the antenna of FIG. 1 embedded into the construction material 240, as such a concatenation would not work. First, the antenna of FIG. 1, even if it had the same basic design as in FIG. 2, would typically use a different dielectric material in space 242. As a result, simply embedding the antenna of FIG. 1 into the dielectric construction material 240 would severely detune the antenna due to the substitution of a different dielectric material 242 between its radiating elements 230 and its sub-reflector 250. Accordingly, the radiating structure would not efficiently couple RF energy at its intended frequency of operation. Second, the radiating elements 230 in FIG. 2 radiate directly into the dielectric construction material 244 and then into free space. In contrast, in the antenna of FIG. 1, the radiating elements would typically radiate directly into free space. The presence of dielectric construction material 244 would further destroy the resonance of the radiating structure of FIG. 1 and distort its radiation pattern.

In FIG. 2, the antenna is shown fabricated wholly within the construction material 240. Geometrical design parameters such as the number, spacing, and dimensions of the radiating elements 230 and sub-reflector 250, along with feedline parameters such as number, length, and impedance can be designed and if necessary optimized by automated calculation utilizing a commercially available three-dimensional (3D) software design package, such as Ansoft HFSS®, Agilent EMDS®, Applied Wave Research Microwave Office®, CST Microwave Studio® or similar. This design take into account the existence of the dielectric construction material 240. Thus, the antenna apparatus 200 is designed to produce the radiation pattern 210, assuming the presence of dielectric construction material 240.

This approach can be used to simultaneously accomplish three objectives as a result of the radiating elements 230 being embedded wholly within a dielectric construction material 240.

First, the dielectric construction material in region 244 forms an integrated dielectric lens. This material 244 acts to modify the direction of the radiated energy relative to propagation in free space. The change of propagation direction is determined by the complex permittivity, $\in_r=\in_r'-j\in_r''$ of the construction material 244 used and the angles of incidence at the radiator 230—material 244 boundary and at the material 244—free space boundary. Careful arrangement of the radiating elements 230, through the methods described above, guide the RF beam in a specific direction, in part by utilizing the intervening material 244 as a medium of refraction for the propagating RF energy, i.e. as a dielectric lens.

In addition, as depicted by ray 212 in FIG. 2, at the interface between the construction material 244 and free-space, a specific angle of incidence upon this interface exists, know in prior art as the critical angle, at which the RF energy remains trapped within the host material 240. This further acts to beneficially limit the total angle of radiation of RF energy from the construction material 240 into free space.

Second, the material 240 in which the radiating elements 230 are embedded acts to store RF energy in an electric field. The amount of stored energy is greater than that in an equivalent volume of free space by a factor of $\in_r$. This additional energy storage serves to increase the capacitive loading at the radiating elements 230 of the antenna, resulting in making their dimensions smaller. Such a reduction in size of the radiating elements 230 and sub-reflector conductors 250 is usually desirable. Such a reduction in size also typically is not available for prior art radiating elements which are simply affixed to, or behind, walls, ceilings or floors.

Further, the increased energy storage of the material 240 over free space, due to the dielectric loading of the surrounding construction material 240, acts to isolate the radiating elements 230 from variations in their surroundings. That is, objects placed near an antenna in free space not only distort its radiation pattern, but also act to increase the capacitive loading on its radiating elements, altering tuning away from its resonant point and shifting its driving-point impedance from that of its intended, or design, value. In FIG. 2, the increased dielectric loading intrinsic to the construction material 240 surrounding the radiating elements 230 acts to isolate the radiating elements to the effects of objects placed outside the construction component 249. Such loading "swamps" the driving point impedance, provides a degree of isolation and reduces return loss variations as objects approach.

Third, by wholly embedding the radiating elements 230 into a section of the construction material 240, their dimensions and placement within the material can be precisely optimized for efficient radiation through that material into the free-space coverage region beyond. Further, no distortion of the intended area of coverage, nor detuning of the antenna results from propagating through the material, as the positions of the elements have been designed for operation within the material 240.

An additional advantage of embedding the radiating elements 230 in the construction material 240 is that the thickness of the material allows for a non-planar arrangement of the radiating elements. Radiating elements, arranged internally so as to direct the beam into a specific volume of space, are limited in their pointing ability if confined to a flat plane. While much prior art is devoted to such antennas—patch, array, panel, and slot radiators among them—a lack of variation in the third dimension limits their beam collimation efficiency without complicated phasing and feed arrangements. The use of a construction material's thickness to vary the spacing in the third dimension from front (i.e. radiation output) surface to radiating elements, as well as varying spacing from radiating elements to sub-reflectors, affords two additional degrees of freedom to an antenna designer.

The introduction of radiating elements within a construction component, where a dielectric material fills all spaces within, is a significantly more complex system that offers correspondingly greater degrees of design freedom in beam positioning For example, radiating elements embedded into thick materials, such as a ¾" particle board, allow for an optimized, non-planar placement of radiating elements yielding beam propagation outside the material with a displacement of up to 25° off the surface normal in operation over the 2.4-2.85 GHz ISM band.

Figure 3:
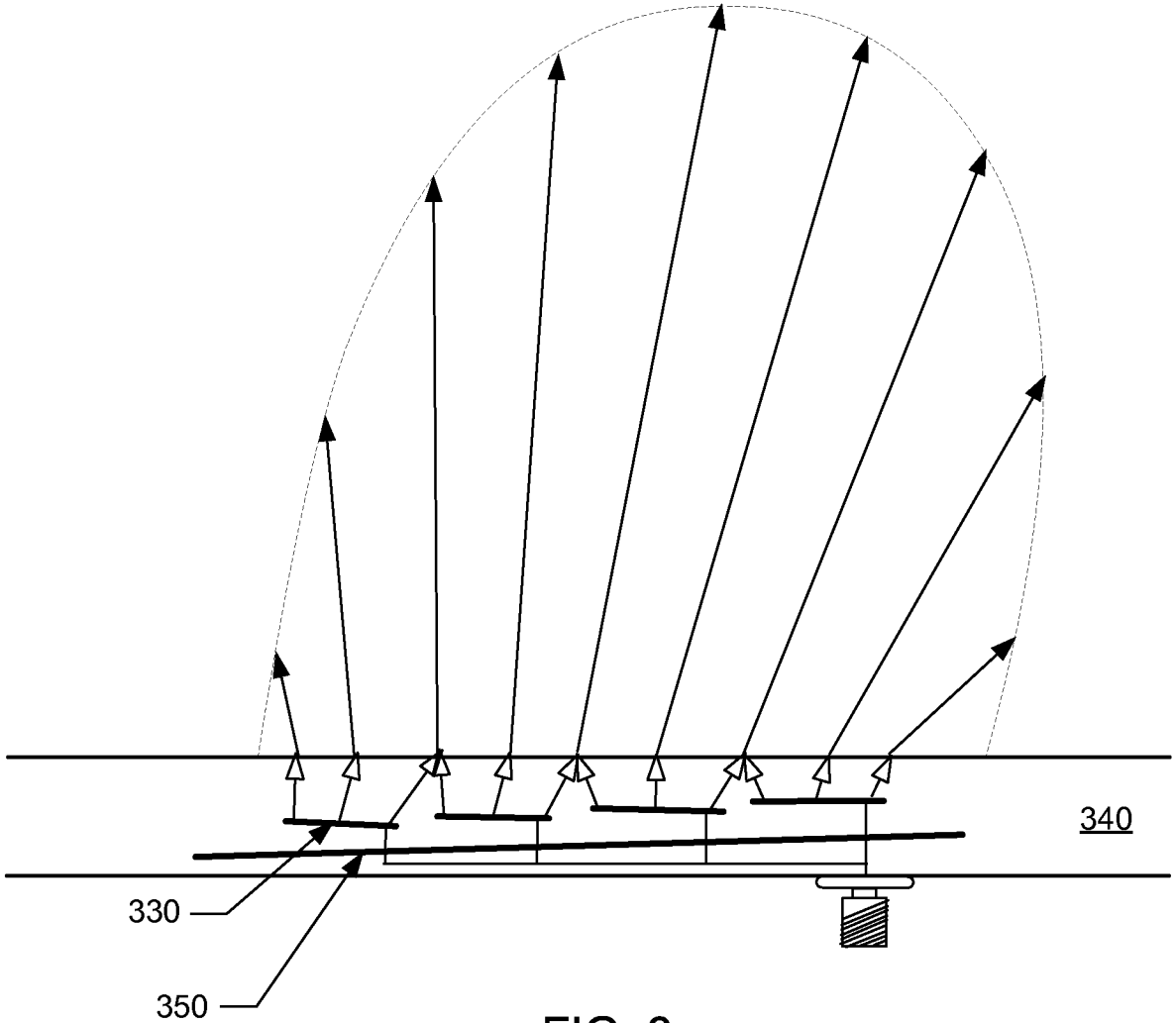
FIG. 3 is a cross-section view of an example antenna apparatus with a three-dimensional array of radiating elements.

FIG. 3 shows an example of a three-dimensional arrangement of radiating elements 330. The radiating elements 330 and sub-reflector 350 are placed within the construction material 340 in a deliberately non-planar fashion. Such placement allows for optimization of the radiated energy concentration outward from the construction material in a direction not necessarily perpendicular to the surface of the construction component. A beneficial result of this arrangement is to compensate for a wall, ceiling, floor, or other interior building section which does not lie perpendicular to the intended region of RF illumination. In other variations, the arrangements of the radiating elements, along with any reflecting material(s) present, may not necessarily be parallel to any edge, or surface, of the construction component in which they are contained. Such an arrangement can be optimized to concentrate the radiated RF energy to a specific target volume of space outside of and not perpendicular to the surface of the construction component in which the radiating elements are embedded.

Figure 4:
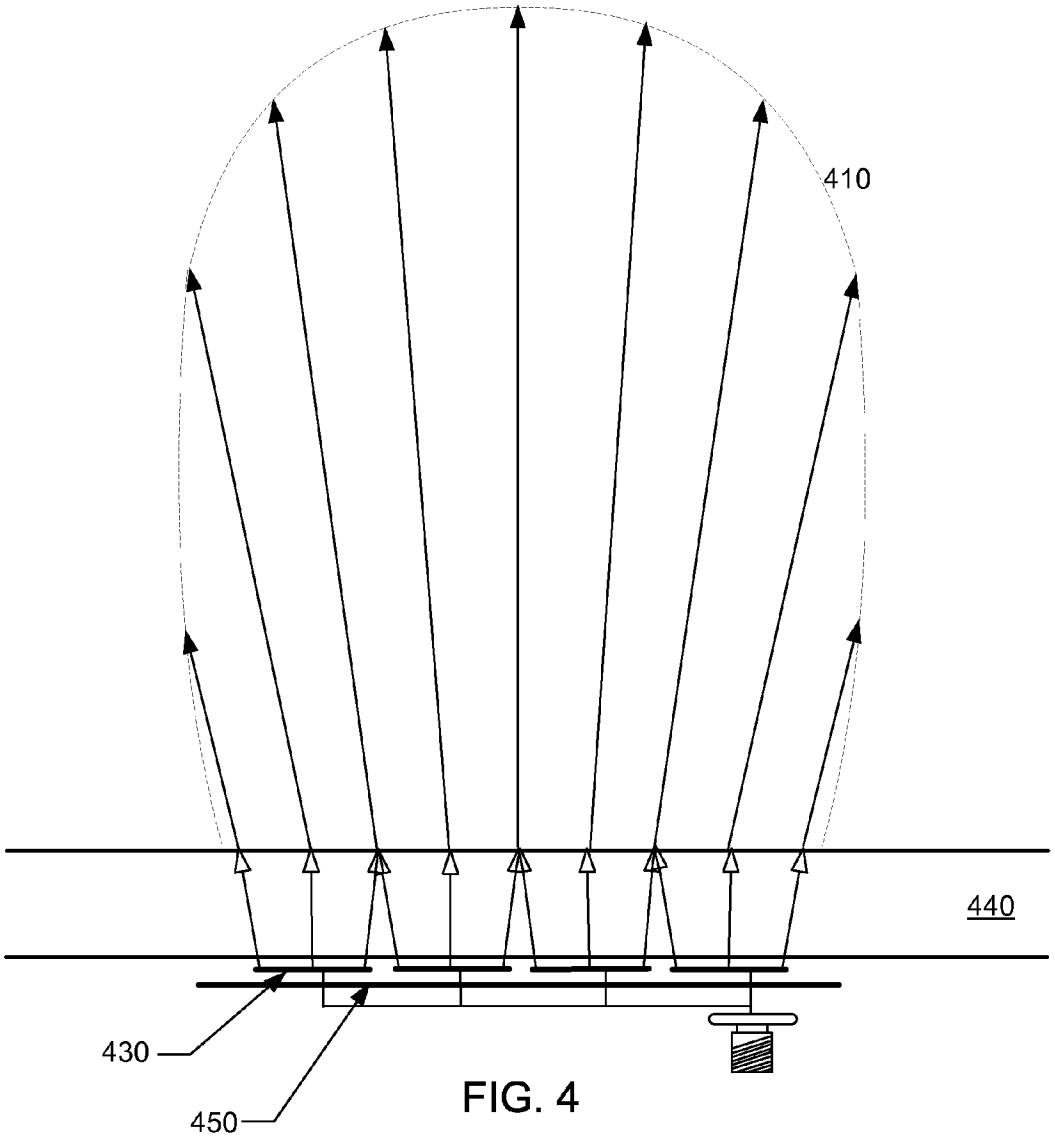
FIG. 4 is a cross-section view of a flexible antenna assembly attached to a construction component.

FIG. 4 shows an example of a flexible circuit implementation that is attached to the surface of an object using an adhesive. Here the conformal RF antenna assembly is specifically designed for the type and thickness of the material 440 to which it is attached. In this example, the RF antenna assembly includes the radiating elements 430, sub-reflector 450 (which are spaced apart from the radiating elements 430) and RF port 460. Although this specific example does not support non-planar arrays or radiating elements 430, it does retain the other two advantages discussed above. Specifically, the dielectric construction material 440 acts as a dielectric lens and exhibits total internal reflection, to limit the beamwidth of the RF energy transmitted beyond the material's opposite side into free space. Also, the dielectric loading of the material 440 will act to "swamp" the input impedance, as in the previous embodiments, thus reducing variations in return loss at the driving point.

Although the detailed description contains many specifics, these should not be construed as limiting the scope of the invention but merely as illustrating different examples and aspects of the invention. It should be appreciated that the scope of the invention includes other embodiments not discussed in detail above. For example, the above examples are all unidirectional radiating structures. However, the teachings above can also be applied to bidirectional radiation, as well as radiation in multiple, simultaneous directions in a controlled, specific, predetermined way. Different implementations can also be designed for different frequency ranges, including RF, microwave and millimeter wave.

As another example, the teachings above can also be applied to a host of applications other than building construction. In particular, they can be applied to fixtures and to not-easily-portable equipment, particularly those with outer material or bases fabricated from a dielectric construction material. In one specific example, the above principles can be applied to gaming machines such as slot machines, video poker, and the like which are frequently supported on a base made from dielectric construction materials.

The present invention, particularly in its embodiment as an adhesive-backed flexible circuit applied to the inside of the material forming the base of a gaming machine, is particularly well suited to addressing the problems of initially manufacturing and later retrofitting gaming machines with RF location tracking and communications abilities in an extremely efficient manner. Such fabrication or retrofit typically does not require alteration to the base, is ultimately unobtrusive and is undetectable due to the fact that the radiating elements reside wholly inside the base. Further, it does not require any modification to, or subsequent recertification of, the game console itself. Beneficially, it utilizes the base's native material as a dielectric lens to improve the directionality of the radiation pattern and lessen the detuning effects of nearby objects on the antenna's driving point impedance, unlike prior art "concealed" antennas. Finally, such an application allows for a multiplicity of such antennas located on various portions, or sides, of the base, possibly allowing RF tracking devices linked to the antennas to determine direction of approach, approach velocity, and position with respect to the base without being visible.

Various other modifications, changes and variations which will be apparent to those skilled in the art may be made in the arrangement, operation and details of the method and apparatus of the present invention disclosed herein without departing from the spirit and scope of the invention as defined in the appended claims. Therefore, the scope of the invention should be determined by the appended claims and their legal equivalent.

The invention claimed is:

1. An RF antenna apparatus, the antenna apparatus comprising:

a construction component containing a first piece of dielectric construction material;

an RF port attached to the construction component and electrically accessible from outside the construction component; and a plurality of radiating elements and a conducting sub-reflector embedded in a non-planar arrangement within the construction component, the plurality of radiating elements including a first radiating element and a second radiating element, the first radiating element a first depth from a surface of the construction component, the second radiating element a second depth from the surface of the construction component, one or more of the first radiating element and second radiating element having a flat surface, the flat surface oriented neither parallel to the surface of the construction component nor orthogonal to the surface of the construction component, the radiating elements electrically connected to the RF port and configured to radiate directly into the first piece of dielectric construction material before radiating into free space outside the construction component, the radiating elements supported by a portion of dielectric construction material located behind the radiating elements relative to the free space and between the radiating elements and the sub-reflector, wherein the dielectric construction material located behind the radiating elements relative to the free space and between the radiating elements and the sub-reflector is the same as the dielectric construction material contained in the construction component.

2. The RF antenna apparatus of claim 1 wherein the radiating elements comprise one or more conducting linear rod(s).

3. The RF antenna apparatus of claim 1 wherein the radiating elements comprise one or more conducting flat surface(s).

4. The RF antenna apparatus of claim 1 wherein the radiating elements comprise an array of conducting elements.

5. The RF antenna apparatus of claim 1 wherein the dielectric construction material comprises at least one of gypsum board, particle board, plywood, fiberglass, cement board and chipboard wall.

6. The RF antenna apparatus of claim 1 wherein the dielectric construction material comprises a floor underlayment material.

7. The RF antenna apparatus of claim 1 wherein the dielectric construction material comprises at least one of Styrofoam, rigid board and insulating foam.

8. The RF antenna apparatus of claim 1 wherein the dielectric construction material comprises a ceiling tile material.

9. The RF antenna apparatus of claim 1 wherein the construction component is a wall component.

10. The RF antenna apparatus of claim 1 wherein the construction component is a floor component.

11. The RF antenna apparatus of claim 1 wherein the construction component is a ceiling component.

12. The RF antenna apparatus of claim 1 wherein the dielectric construction material enhances a directivity of a radiation pattern.

13. The RF antenna apparatus of claim 1 wherein the portion of the dielectric construction material is a dielectric backing, the dielectric backing being designed to provide a support to the plurality of radiating elements.

14. The RF antenna apparatus of claim 1 wherein a radiation pattern is directed equally to opposite sides of the construction component.

15. The RF antenna apparatus of claim 1, wherein the conducting sub-reflector is positioned relative to the radiating elements and the dielectric construction material to enhance a directivity of a radiation pattern and the sub-reflector is not electrically connected to the radiating elements and to the RF port.

16. The RF antenna apparatus of claim 1 wherein the radiating elements are positioned in a plane non-parallel to a surface of the construction component.

17. The RF antenna apparatus of claim 1 wherein a radiation pattern is directed primarily to a preferred side of the construction component.

18. The RF antenna apparatus of claim 17 wherein dielectric construction material is located between the radiating elements and free space outside the preferred side of the construction component.

19. The RF antenna apparatus of claim 17 wherein the radiation pattern has maximum gain along a direction that is not substantially perpendicular to a surface of the construction component.

20. An RF antenna assembly for attachment to an object containing a first piece of dielectric construction material comprising: a plurality of radiating elements and a conducting sub-reflector placed in a non-planar arrangement, the plurality of radiating elements including a first radiating element and a second radiating element, the first radiating element a first depth from a surface of the object, the second radiating element a second depth from the surface of the object, one or more of the first radiating element and second radiating element having a flat surface, the flat surface oriented neither parallel to the surface of the object nor orthogonal to the surface of the object, the plurality of radiating elements configured to radiate directly into the first piece of dielectric construction material before radiating into free space outside the object, the antenna assembly having a side attachable to the surface of the object; the radiating elements supported by a portion of dielectric construction material located behind the radiating elements relative to the free space and between the radiating elements and the sub-reflector, wherein the dielectric construction material located behind the radiating elements relative to the free space and between the radiating elements and the sub-reflector is the same as that of the first piece of dielectric construction material; and an RF port electrically connected to the plurality of radiating elements.

21. The RF antenna assembly of claim 20, wherein the antenna assembly is a conformal structure attachable to the surface of the object by an adhesive compound.

22. The RF antenna assembly of claim 20, wherein the dielectric construction material of the object enhances a directivity of a radiation pattern.

23. The RF antenna assembly of claim 20, wherein a radiation pattern is directed primarily to a side of the object that is opposite the surface to which the antenna assembly is attached.

24. The RF antenna assembly of claim 20, wherein the radiating elements are located between the object and the conducting sub-reflector and the sub-reflector is not electrically connected to the radiating elements and not electrically connected to the RF port.

25. The RF antenna assembly of claim 20, wherein the antenna assembly is attachable to a base of a gaming machine, the base being the object and including the dielectric construction material.

* * * * *